US006890113B2

(12) United States Patent
Block

(10) Patent No.: US 6,890,113 B2
(45) Date of Patent: May 10, 2005

(54) TAPE PRINTERS

(75) Inventor: David Block, El Cerrito, CA (US)

(73) Assignee: Esselte, Sint-Niklaas (BE)

( * ) Notice: Subject to any disclaimer, the term of this patent is extended or adjusted under 35 U.S.C. 154(b) by 0 days.

(21) Appl. No.: 10/323,830

(22) Filed: Dec. 20, 2002

(65) Prior Publication Data

US 2003/0143012 A1 Jul. 31, 2003

(30) Foreign Application Priority Data

Dec. 21, 2001 (GB) ..... 0130689

(51) Int. Cl.[7] ..... B41J 11/44

(52) U.S. Cl. ..... 400/615.2; 400/61; 400/70; 400/76

(58) Field of Search ..... 400/615.2, 61, 400/70, 76

(56) References Cited

U.S. PATENT DOCUMENTS

| | | | | |
|---|---|---|---|---|
| 4,875,174 A | | 10/1989 | Olodort et al. | |
| 5,503,482 A | * | 4/1996 | Kawakami et al. | 400/83 |
| 5,544,287 A | * | 8/1996 | Roth | 358/1.15 |
| 5,584,591 A | * | 12/1996 | Mori et al. | 400/615.2 |
| 5,609,424 A | * | 3/1997 | Sakuragi et al. | 400/61 |
| 5,700,098 A | | 12/1997 | Beadman et al. | |
| 5,720,157 A | * | 2/1998 | Ross | 53/445 |
| 5,967,679 A | * | 10/1999 | Beadman et al. | 400/615.2 |
| 6,079,889 A | * | 6/2000 | Beadman et al. | 400/615.2 |
| 6,296,406 B1 | | 10/2001 | Kurashina | |
| 6,375,306 B1 | * | 4/2002 | Tsukagoshi | 347/40 |
| 6,459,943 B1 | * | 10/2002 | Suetani et al. | 700/96 |
| 6,567,088 B2 | * | 5/2003 | Hayama | 345/472 |

FOREIGN PATENT DOCUMENTS

| | | |
|---|---|---|
| EP | 267 890 | 5/1988 |
| EP | 322 918 | 7/1989 |
| EP | 322 919 | 7/1989 |
| EP | 587 372 | 1/1994 |
| EP | 1 040 928 | 10/2000 |

* cited by examiner

*Primary Examiner*—Charles H. Nolan, Jr.
(74) *Attorney, Agent, or Firm*—Morgan, Lewis & Bockius LLP

(57) ABSTRACT

The present invention relates to a tape printing system for printing an image on an image receiving tape comprising means for receiving a supply of image receiving tape; means for generating a plurality of labels from a data source, said generating means comprising means for receiving said data, means for processing said data to identify individual label data to be printed on said plurality of labels and means for generating label date from the identified individual label data; and means for printing said plurality of labels.

22 Claims, 7 Drawing Sheets

TAPE PRINTERS

The present invention relates to a tape printer. The tape printer may be a stand-alone tape printer or a tape printer which is arranged to be used with a PC or the like.

Tape printers of the general type with which the present invention is concerned are disclosed in EP-A-322918 and EP-A-322919 (Brother Kogyo Kabushiki Kaisha) and EP-A-0267890 (Varitronics). These printers each include a printing device having a cassette receiving bay for receiving a cassette or a tape holding case. In EP-A-0267890, the tape-cassette has an ink ribbon and a substrate tape, the substrate tape comprising an upper image receiving layer secured to a backing layer by adhesive. In EP-A-322918 and EP-A-22919, a tape cassette houses an ink ribbon, a transparent image receiving tape and a double-sided adhesive tape, which is secured at one of its adhesive coated sides to the image tape after printing and which has a backing layer peelable from its other adhesive coated side. The image is printed on the side of the image receiving tape, which is adhered to the adhesive coated tape. Thus, the printed image is covered by a protective layer. In both of these tape printers, the image transfer medium (ink ribbon) and the image receiving tape (substrate) are in the same cassette.

The present applicants have developed a different type of tape printer, which is described in, for example, European Patent Application No. 578372. In this printer, the substrate tape has a structure similar to that described in EP-A-267890 but is housed in its own cassette, whilst the ink ribbon is similarly housed in its own cassette.

In all of these cases, the image receiving tape passes in overlap with the ink ribbon through a print zone consisting of a fixed print head and a platen against which the print head can be pressed to cause an image to transfer from the ink ribbon to the image receiving tape. There are many ways of doing this, including dry lettering or dry film impression, but the most usual way at present is by thermal printing, where the print head is heated and the heat causes ink from the ink ribbon to be transferred to the image receiving tape. It should be appreciated that it is also known to apply an image directly using a thermal print head to thermally sensitive image receiving tape.

Tape printers fall into two categories: stand-along tape printers and tape printers which can be used in conjunction with a PC. With the stand-along tape printers, information defining the image to be printed can be entered via a keyboard or the like. In those cases where the tape printer is controlled by a PC, the label data is entered via the PC and then downloaded to the tape printer, which prints the required labels. In this latter case, the tape printer is under the control of the PC. Some tape printers are able to operate in two different modes. In one mode of operation, the tape printer can be controlled by the PC, and in another mode of operation, the tape printer can operate in a stand-alone mode.

Currently, when a user wishes to print a batch of labels, it is necessary for the user to input each label. Whilst some tape printers have a number or letter incrementing facility, labels having different information can only be obtained by the separate input of that information This is particularly disadvantageous where a number of labels need to be printed.

It is therefore an aim of embodiments of the present invention to at least address the above described problem.

According to a first aspect of the present invention there is provided a tape printing system for printing an image on an image receiving tape comprising means for receiving a supply of image receiving tape, means for generating a plurality of labels from a data source, said generating means comprising means for receiving said data, means for processing said data to identify data to be printed on said plurality of labels; and means for printing said plurality of labels.

According to a second aspect of the present invention there is provided a tape printing method for printing an image on an image receiving tape comprising the steps of receiving data containing information for a plurality of labels, processing said data to identify individual label data to be printed on said plurality of labels; generating a plurality of labels from the identified data; and printing said plurality of labels.

According to a further aspect of the present invention there is provided a tape printing system for printing a label on an image receiving tape comprising means for receiving a supply of image receiving tape, means for inputting at a graphic image to be printed on said image receiving tape, commons means allowing a user to select the size of said graphic image, and printing means for printing said graphic image with the size selected by said user.

For a better understanding of the present invention and as to how same may be carried into effect, reference will now be made by way of example only to the accompanying drawings, in which.

Figure 1:
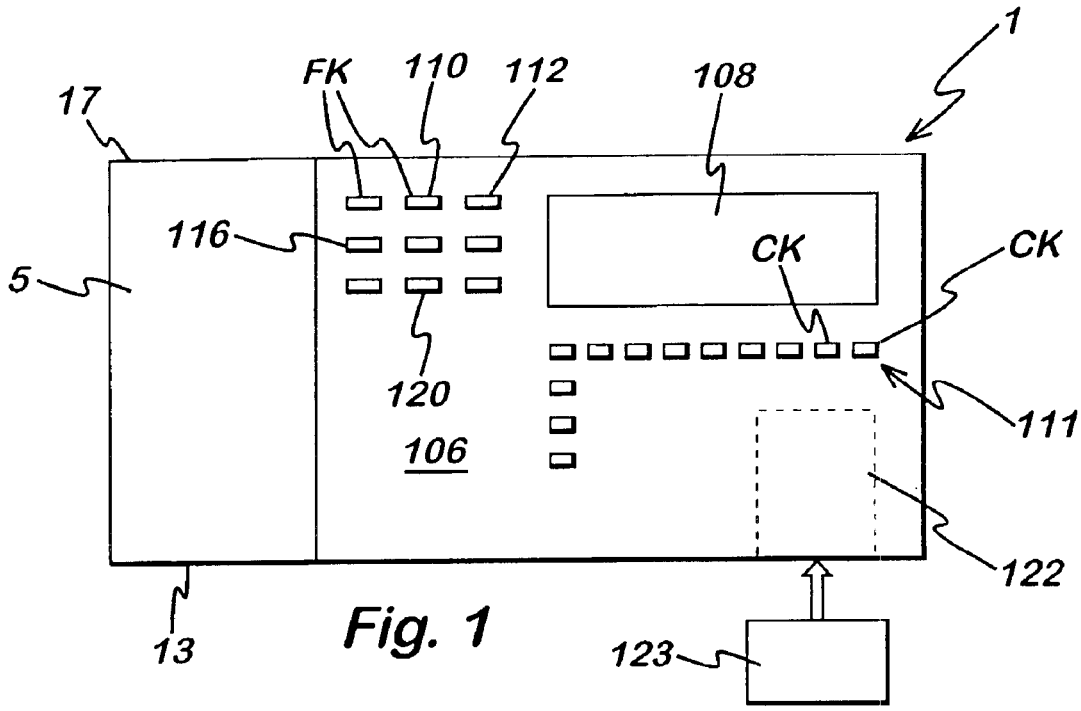
FIG. 1 shows a plan view of the top surface of a stand-alone printing device.

Reference is made first to FIG. 1, which shows a stand-alone printer 1 embodying the present invention. The tape printer 1 has a cassette receiving bay 13, which is arranged to receive two cassettes, as will be described in more detail with reference to FIG. 2. The cassette receiving bay 13 is covered by a lid 15, which is hinged along the line 17 at the rear of the printer and which can be opened from the front to reveal the cassette in the cassette receiving bay 13. It should be appreciated that in alternative embodiments of the present invention, the cassette receiving bay can be provided In alternative locations. For example, the cassette receiving bay can be provided at a different position with respect to the keyboard and display. Alternatively, the cassette receiving bay can be located on the underside of the tape printer.

The tape printer 1 has a keyboard 106, which has a plurality of character keys CK designated generally by arrow 111. The keyboard 106 also has a plurality of function keys FK, which are designated by way of example with reference numerals 110, 112, 116 and 120. Using the keyboard 106, the user is able to control the tape printer. For example, the user is able to enter data defining a label to be printed. The label can comprise characters, numbers, symbols or the like. The function keys can control the appearance of the data and may control the label attributes, i.e attributes such as boxing, underlining or the like, or character attributes such as font, style, size, etc. As will be described in more detail hereinafter, in preferred embodiments of the present invention, the keyboard 106 is also able to control the tape printer 106 to automatically generate labels from a data file.

The tape printer 1 also has a display 108, which is able to display information for the user. The information displayed by the display may be the label which is to be printed. For example, as the user inputs label data, this may be displayed on the display. Alternatively, the display may provide information to the user, for example, indicating that the tape printer is processing, printing, or other such information.

Figure 2:
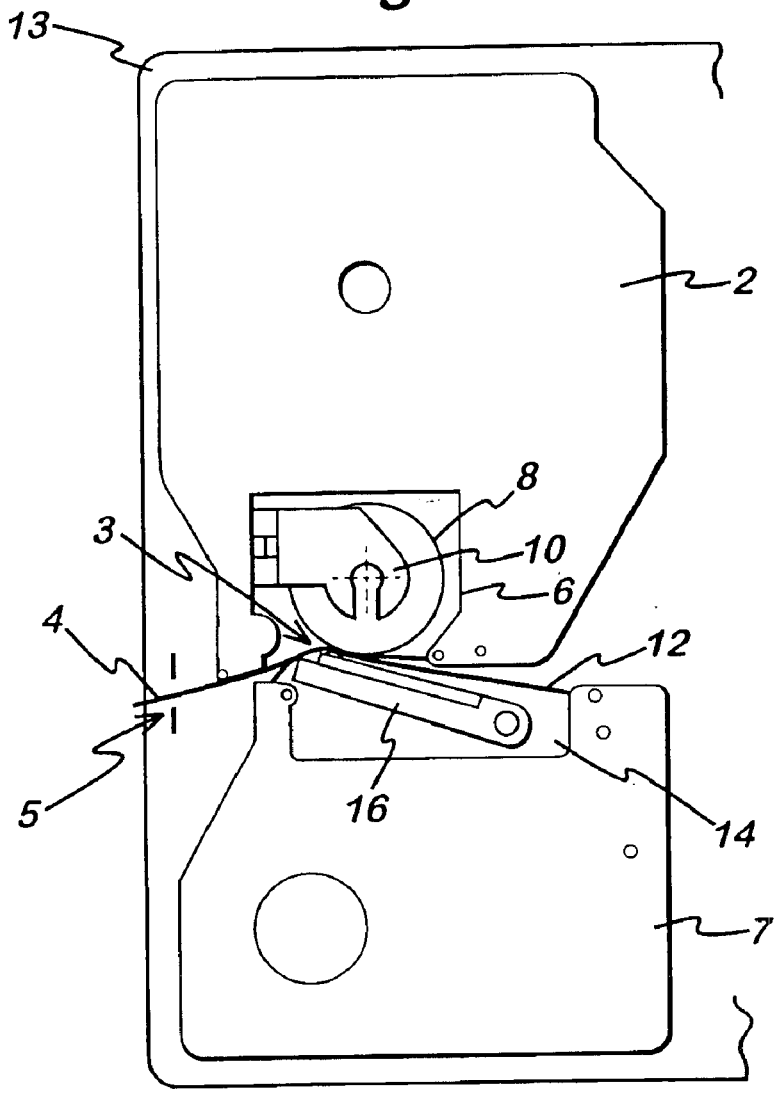
FIG. 2 is a plan view showing two cassettes inserted in the printing device of FIG. 1.

Reference is made to FIG. 2, which shows in plan view two cassettes arranged in the cassette receiving bay 13 of the printing device. The upper cassette 2 contains a supply of image receiving tape 4, which passes through a print zone 3 of the tape printer to an outlet 5. The image receiving tape 4 comprises an upper layer for receiving a printed image on one of its surfaces and having its other surface coated with an adhesive layer to which is secured a releasable backing layer. The cassette 6 has a recess 6 for accommodating a platen of the printer. The platen 8 is mounted for rotation within a cage moulding 10. The lower cassette 7 contains a thermal transfer ribbon which extends from a supply spool to a take-up spool within the cassette 7. The thermal transfer ribbon 12 extends through the print zone 3 in overlap with the Image receiving tape 4. The cassette 7 has a recess 14 for receiving a print head 16 of the printer. The print head is movable between an operative position shown in FIG. 2, in which it abuts against the platen and holds the thermal transfer ribbon 12 and the image receiving tape in overlap between the print head and the platen and an inoperative position in which it is moved away from the platen to release the thermal transfer ribbon and image receiving tape. In the operative position, the platen is rotated by the action of a stepper motor to cause image receiving tape to be driven past the print head, and the print head is controlled to print an image onto the image receiving tape by the thermal transfer of ink from the ribbon 12. The print head is a conventional thermal print head having a column of pixels, each of which can be thermally activated in accordance with the desired image to be printed.

It should be appreciated that in alternative embodiments of the present invention, a single cassette system may be used. The single cassette may house thermal transfer ribbon and image receiving tape.

In alternative embodiments of the present invention, the two cassette may be replaced by a single cassette, which houses only image receiving tape. The image receiving tape is thermally sensitive in this embodiment.

The tape printer 1 may be arranged so as to be capable of printing an image on different widths of image receiving tape. The tape printer may include a mechanism for detecting the width of the tape present. This may be done by making a determination of the characteristic of the cassette. Alternatively, this information may be provided to the tape printer by the user.

Figure 3:
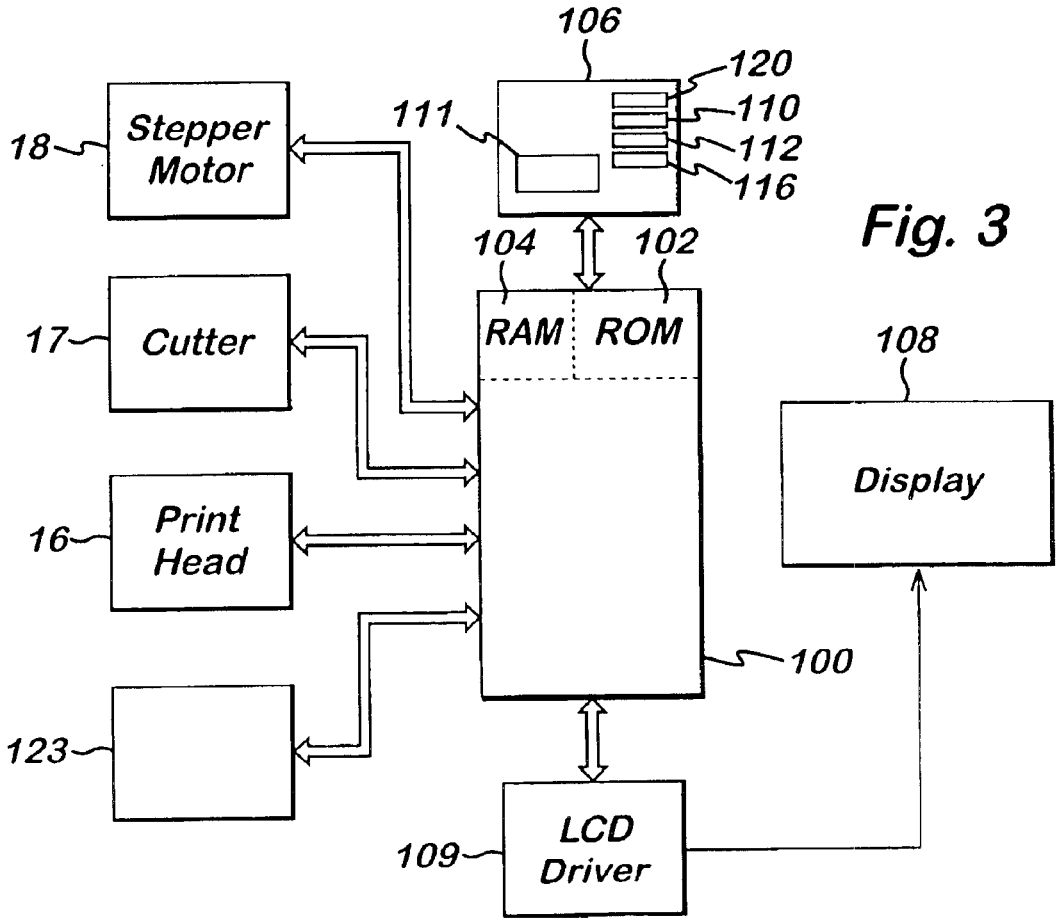
FIG. 3 is a diagrammatic sketch showing the control circuitry for the tape printer FIG. 1.

Reference is made to FIG. 3, which shows schematically the basic circuitry for controlling the tape printer of FIG. 1 and FIG. 2. There is a microprocessor chip 100, having a read-only memory (ROM) 102, a microprocessor 101 and random access memory capacity, indicated diagrammatically by RAM 14. Additional ROM and RAM capacity can be provided by separate ROM and RAM chips connected to the microprocessor. The microprocessor 101 is connected to receive data input to it from a data input device such as the keyboard 106. The microprocessor chip 100 outputs data to drive the display 108 via the display driver chip 109 and also to drive the print head 16 and the stepper motor 18 for controlling the platen. The microprocessor chip also controls a cutting mechanism indicated diagrammatically in FIG. 3 by cutter 17 to cut the printer to tape. The cutter is not shown in FIG. 2, but would be located adjacent the outlet 5. In this embodiment, the cutter is electrically operated. However, in alternative embodiments in the present invention, a manually operated cutter may be provided.

Figure 4:
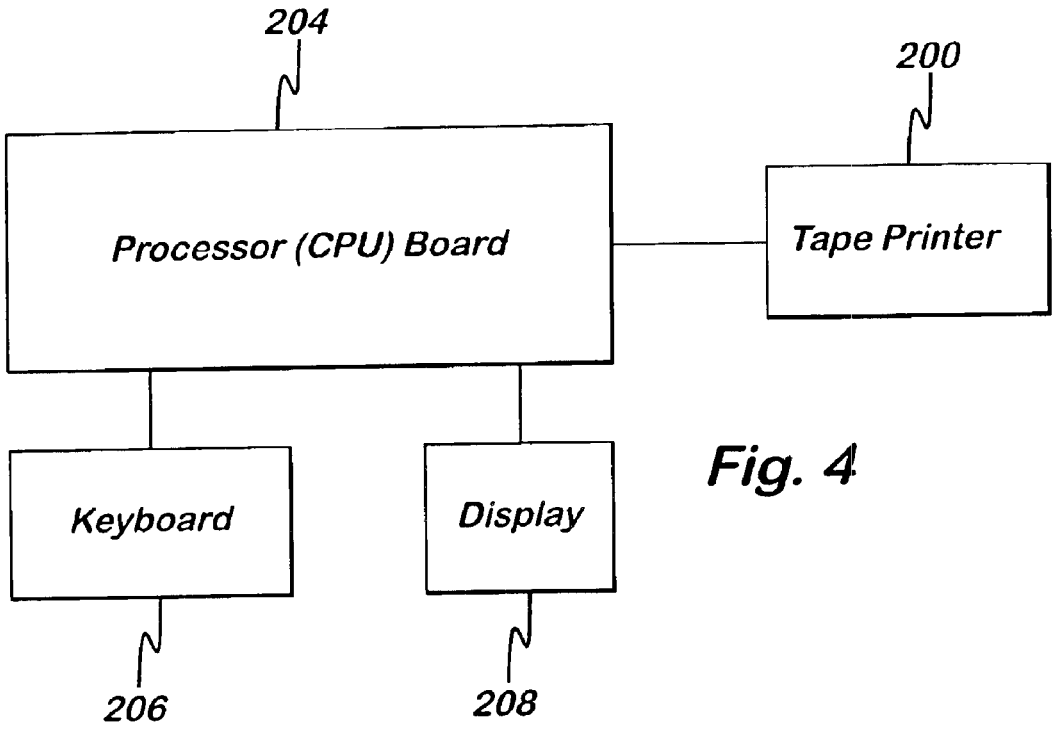
FIG. 4 is a view of a tape printer when controlled by a PC.

Reference is made to FIG. 4, which shows a tape printer 200, which is controlled by a PC 202 or any other suitable type of computer. The PC 202 comprises a processor board 204, which is arranged to control both the PC 202 and the tape printer 200. Connected to the processor board 204 is a keyboard 206, which allows information to be input to the processor board. Also connected to the processor board 204 is a display 208. The display 208 is driven by the processor board. The processor board 204 is arranged to send print information to the tape printer 200 and some control information to the tape printer. The processor board 204 will be arranged to receive data via a disk drive, a CD drive, network connection or by any other known method, in addition to via the keyboard.

It should be appreciated that if the tape printer 200 is arranged only to be used in conjunction with the PC 202, then the tape printer 200 needs not be provided with a keyboard or a display. Additionally, the control circuitry of the tape printer may be simplified compared to that of FIG. 3. In particular, at least some of the control functions can be omitted, for example those relating to the display and keyboard.

Additionally, some of the microprocessor functions described in relation to FIG. 3 may be provided in the hard disk drive.

In alternative embodiments of the present invention, the tape printer 200 may be arranged to have two modes of operation. In the first mode of operation, the tape printer would be controlled by the PC 202. In the second mode of operation, the tape printer would function as a stand-alone tape printer. In that case, the tape printer may have a configuration of the type shown in relation to FIGS. 1 to 3

Both of the tape printers shown in FIGS. 1 to 4 are arranged to have a mode of operation in which a number of labels can be automatically generated. The labels can originate from a data file, a "clipboard function" supported by a computer operating system, or another application. This label data can, for example, consist of a list of names, lists of addresses, lists of names and addresses, lists of articles to be labelled or the like. The data is generally plain ASCII text, but need not be limited to such.

Consider the following examples:

The data contained in the data file may be printed such that the data to be printed on each label is contained in a single line of the data file.

Consider the following example of a data file:

Pencils, US $100

Pens, US $0.50 each

Erasers, US $1

This would generate three labels. The first label would be "Pencils, US $100". The second label would be "Pens, US $0.50 each". The third label would be "Erasers, US $1.00".

In one modification to this embodiment, the PC or label printer software can be arranged to determine if any of the lines contain a comma. Where a comma is located, it can be determined that a new line is required. Thus, the three labels outlined above would each have two lines, each new line beginning after the comma.

Label 1 would thus be:

Pencils,

US $100

Label 2 would be:

Pens,

US $0.50 each

Label 3 would be:

Erasers,

US $1

In some embodiments of the present invention, the comma can be omitted from the two-lined labels.

In one further modification of this embodiment, lines of the label which are to contain commas are themselves in quoted text. For example, consider the following list:

Dymo Corporation, 44 Commerce Road, "Stamford, Conn. 06902"

Esselte Nev., Sint-Niklaas, "9100, Belgium".

In embodiments of the present invention, this would give rise to the following two labels:

Label 1:

Dymo Corporation,

44 Commerce Road,

Stamford, Conn. 06902

The second label, Label 2, would be:

Esselte Nev.,

Sint-Niklaas,

9100, Belgium

In summary, the data can be presented in a list, with each new line representing a new label. Within each label, a new line is started every time a comma is encountered. If a single line on the label is to contain a comma, then the part of the text is Included in inverted commas or the like. The inverted commas are not printed, although the commas are. It should be appreciated that any other indicators other than commas or inverted commas can be used in embodiments of the present invention.

Reference will now be made to a second type of data file from which labels can be automatically generated. In this, the data for each label appears on subsequent lines separated by a carriage return, line feed, or both. Subsequent labels within the data are separated by blank lines. Firstly, the data in the document is examined to see if there are any blank lines in the data. If so, the text is assumed to consist of a plurality of labels, each of which is separated by the blank lines. Consider the following example of a data file:

Pencils

US $1.00

<blank line>

Pens

US $0.50 each

The software is arranged to take the presence of the blank line and would provide labels 1 and 2 as outlined in the respective previous example. Consider the following example:

Tom Smith
Bob Jones
Mike Smith

In this situation, each line becomes its own label, in other words, three labels are provided, one with each of the three names. It is assumed that this is the case if it is detected that there are no blank lines within the data. The data in this latter case may be generated by copying information from a column of a spreadsheet, a word processing document, or other data source.

Figure 5:
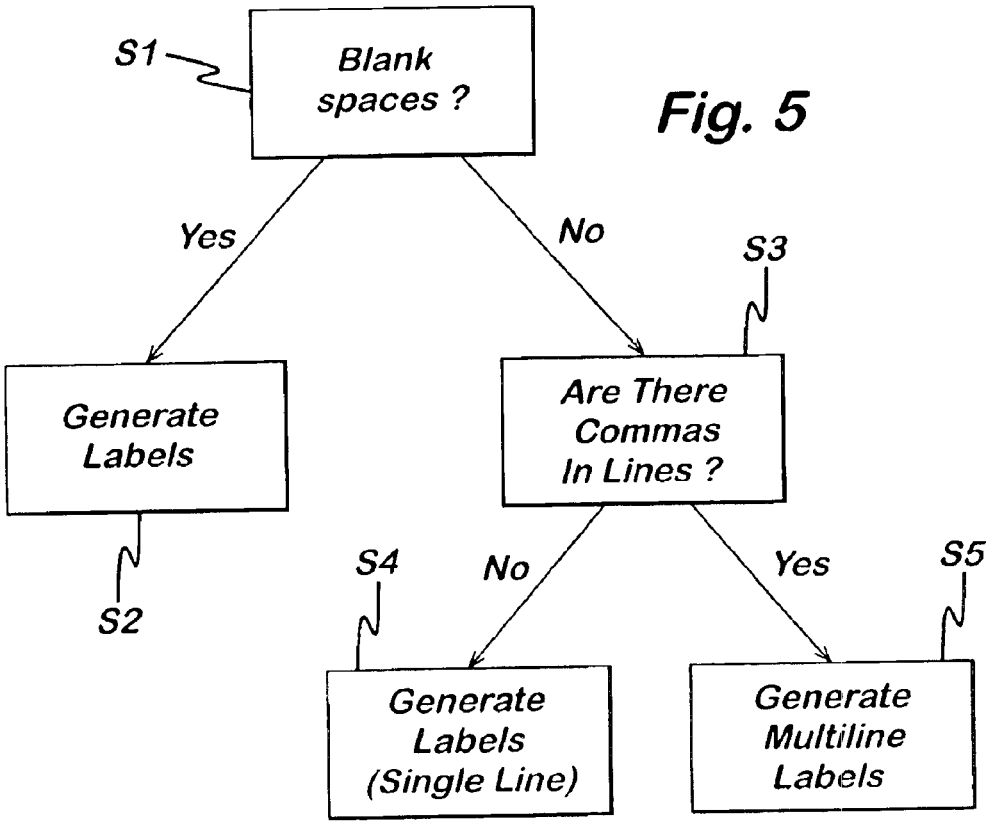
FIG. 5 is a flow diagram illustrating the method embodying the present invention.

Embodiments of the present invention may be able to support the generation of labels from any of the data files mentioned previously FIG. 5 shows a flow chart illustrating how this may be achieved in practice. The data file is considered and in step S1 a determination is made as to whether or not there are any blank lines between the data in the data file. By "blank lines" it is meant an empty line or the like. If it is determined that there are empty lines, then labels are generated as already outlined. Each label consists of the data between two blank lines. This is carried out in step S2.

In step S3, which is the next step if there are no blank lines, then a determination is made as to whether or not there are any commas in each line of data. If no commas are detected, then step S4 is the next step. In step S4, each line represents a single line label, which are then generated. This is as previously outlined. If it is determined in step S3 that there are commas within each line, then the next step is S5. Each line again represents a single label but a determination as to the number of lines of the label is made from the determination of the number of commas. Commas in inverted commas are of course ignored, as outlined previously.

In alternative embodiments of the present invention, only one or some of the various types of data file can be processed.

The data file can take any suitable format. For example, in the case of the tape printer controlled by a PC, the data may be a word processing document, for example a Word or Word Perfect document or the like. Alternatively, the data may be in spreadsheet form, for example, an Excel spreadsheet or the like. Data may be provided to the stand-alone tape printer via any suitable means. Including a "Clipboard" buffer to which the data is copied. Alternatively, the user can enter the data into the tape printer via, for example, the keyboard. That data file may be stored in memory in the tape printer as required.

It should be appreciated that embodiments of the present invention may use other indicators other than the examples of blank spaces to determine the commencement of a new label. Any suitable marker can alternatively be used.

Figure 6:
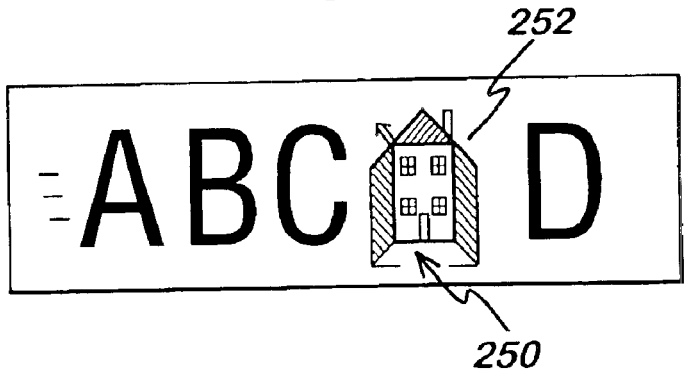
FIG. 6 shows schematically an image of a tape as displayed on a display.

The processing of the data file is done in the microprocessor of the tape printer, in the case of the stand-alone tape printer, or the processor of the processor board 204, in the case of the PC controlled tape printer In embodiments of the present invention, it is also possible to include pictures, graphics, images or the like in the label. In this regard, reference is made to FIG. 6, which shows an example of a label which includes a graphic element 250. In embodiments of the present invention, the graphic element 250 is treated as a character. In particular, the size of the graphic element is controlled by the character size. For example, if the user wishes to make the graphic smaller or larger, the curser 252 is moved so that it is over the symbol. The image shown in FIG. 6 is either displayed on the display of the tape printer, if it is operating in the stand-alone mode, or on the display of the PC. The movement of the cursor is controlled by movement keys on the keyboard associated with the tape printer or the PC, respectively. In order to change the size of the image, the change in size is achieved by a change in character size. This may be achieved in any way. For example, in some embodiments of the present invention, a character size menu is obtained and the appropriate size selected. In other embodiments of the present invention, a key can be actuated, which allows a character size to be selected. In some embodiments of the present invention, this can be done on a character by character basis. It should be appreciated that in this context character includes alphanumeric, numbers or symbol. If the image is in a string of characters, the string of characters and image can be selected and the size of the characters and the image are altered together. In this embodiment, both the character size and the Image size will be changed together. In other words, the image and the character are treated in the same way.

It should be appreciated that the maximum height of the graphic is controlled by the size of tape.

As shown schematically in FIG. 1, the tape printer has a slot 122 in which a memory card 123 can be slotted. The memory card may store data as described hereinbefore or the generated labels. The memory card can take any suitable format and may for example be a card having an integrated circuit thereon such as a smart card card or a card similar to a SIM card. Alternatively, the card 122 may be a memory card similar to a floppy disk, CD or mini disk or any other suitable data storage medium. In alternative embodiments of the present invention, the memory or integrated circuit may be incorporated in a format other than a card-like format.

In one embodiment of the present invention, the memory card or the like contains bit map images or any other suitable type of image. These images can be used as the basis of a label. In one preferred embodiments of the present invention, the image cannot be altered by the user but the user is able to add additional text. The image can be text, graphics or the like Reference is made to FIG. 7 which shows an arrangement embodying the present invention. In this arrangement, a docking station 600 is arranged to be connected to a PC 602 or any other suitable computer device. The docking station is arranged to receive the memory card, integrated circuit or the like and is in practice a chip card writer and optionally a reader. Information downloaded from the PC 602 is downloaded via the docking station onto the card 123. The docking station 600 simply provides a connection between the PC 602 and the memory card or the like 123. This information can take any of the forms outlined hereinafter may be labels, image data, fonts or may be programming if the card is an integrated circuit with microprocessor capacity or the like. Once the card has received the downloaded information, the card can be used with the tape printer 604 which includes a slot 608 to receive the card 123 or the like.

Figure 7:
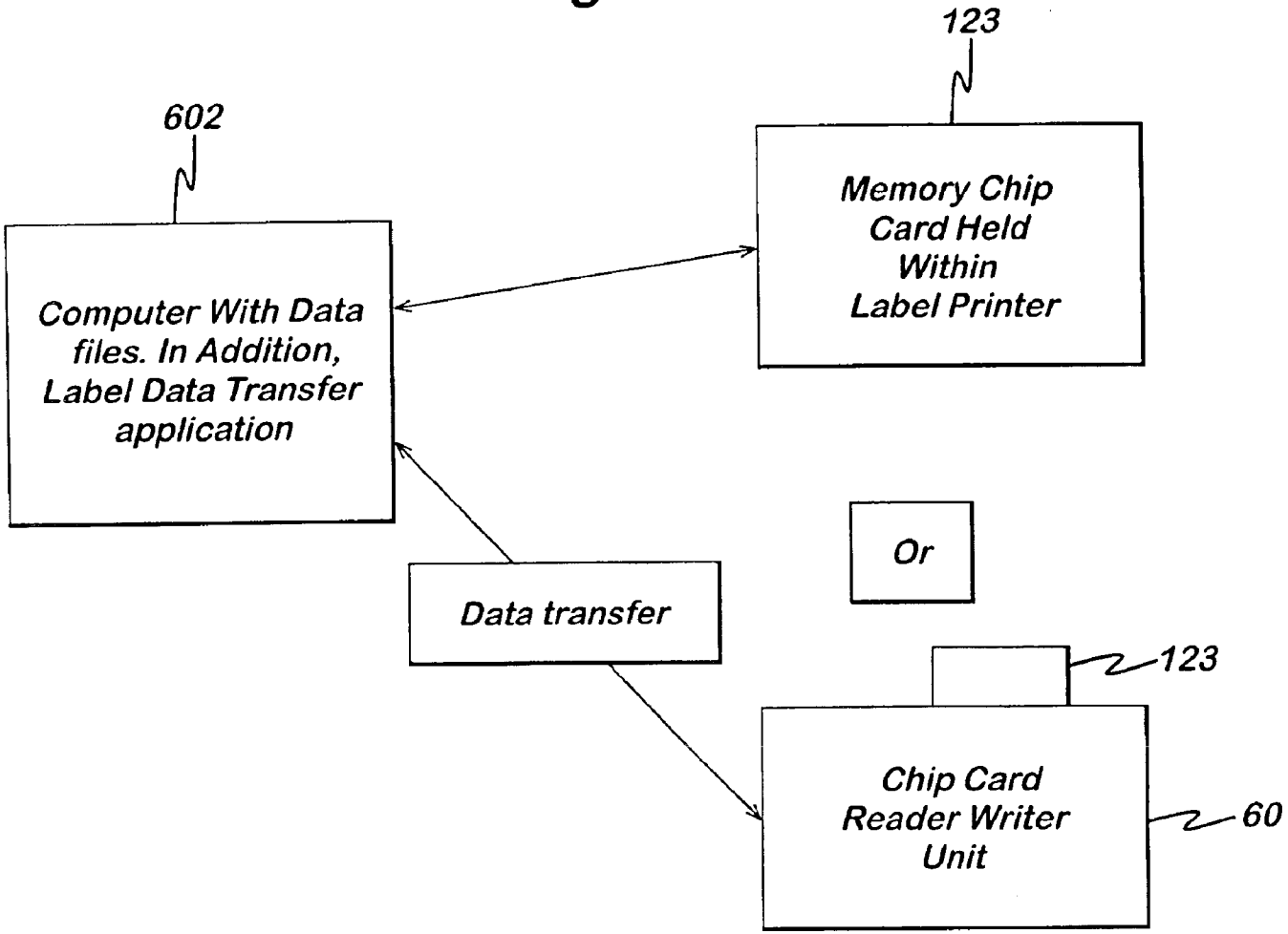
FIG. 7 shows a further embodiment of the present invention.

In one modification also shown in FIG. 7, the tape printer 604 is itself able to act as a docking station. The information form the PC is downloaded via the tape printer onto the memory card 123 or the like. In yet an alternative embodiment of the present invention, the memory card or the like is inserted into the tape printer 604 and the memory card or the like is connected to the PC via a SUB or similar connection. Data from the PC can then be downloaded directly to the memory card or the like. In the latter case, the memory card or the like may be factory fitted or may be fitted and/or changed by the user. This latter option would require a serial R48 or RJ11 jack or the like built into the tape printer.

It should be appreciated that a separate card writer which is able to write multiple copies of the same data may be advantageous where a common one or more data cards need to be given to a number of people. For examples, a garage chain may provide each of its outlets with all the retail SKU items listed.

As can be seen from FIG. 3, there is a connection between the memory card 123 and the microprocessor chip 100. The microprocessor 100 is able to access the prestored labels, fonts, graphic images or the like stored in the memory chip 123 in a similar manner to the way in which it is able to retrieve data from the RAM 104 or ROM 102.

Tape printers embodying the present invention may be used In a number of different environments. For example, some tape printers may be used in the home. The tape printer may be primarily used by adults or by children. The tape printer may be used in an office environment or may be used by electricians, plumbers, workers on oil rigs or the like. The same printers can therefore be used by quite different people who have different requirements. Accordingly, a different memory card can be provided for different groups of people.

Of course, different labels may be required in an office environment to, for example, label computers, shelves, files, packages, to produce address labels, to provide notices or the like.

Electricians may require different labels for example to label cables, fuse boxes, circuits. Likewise, plumbers may have different label requirements. A different card can be produced containing sets of labels for each of these different groups of people.

This means that the same label printer may be adapted to be used by a wide range of people.

It should be appreciated that in addition or alternatively, the memory cards can store different fonts and/or can store graphic images which can be imported by the user into labels.

Figure 8:
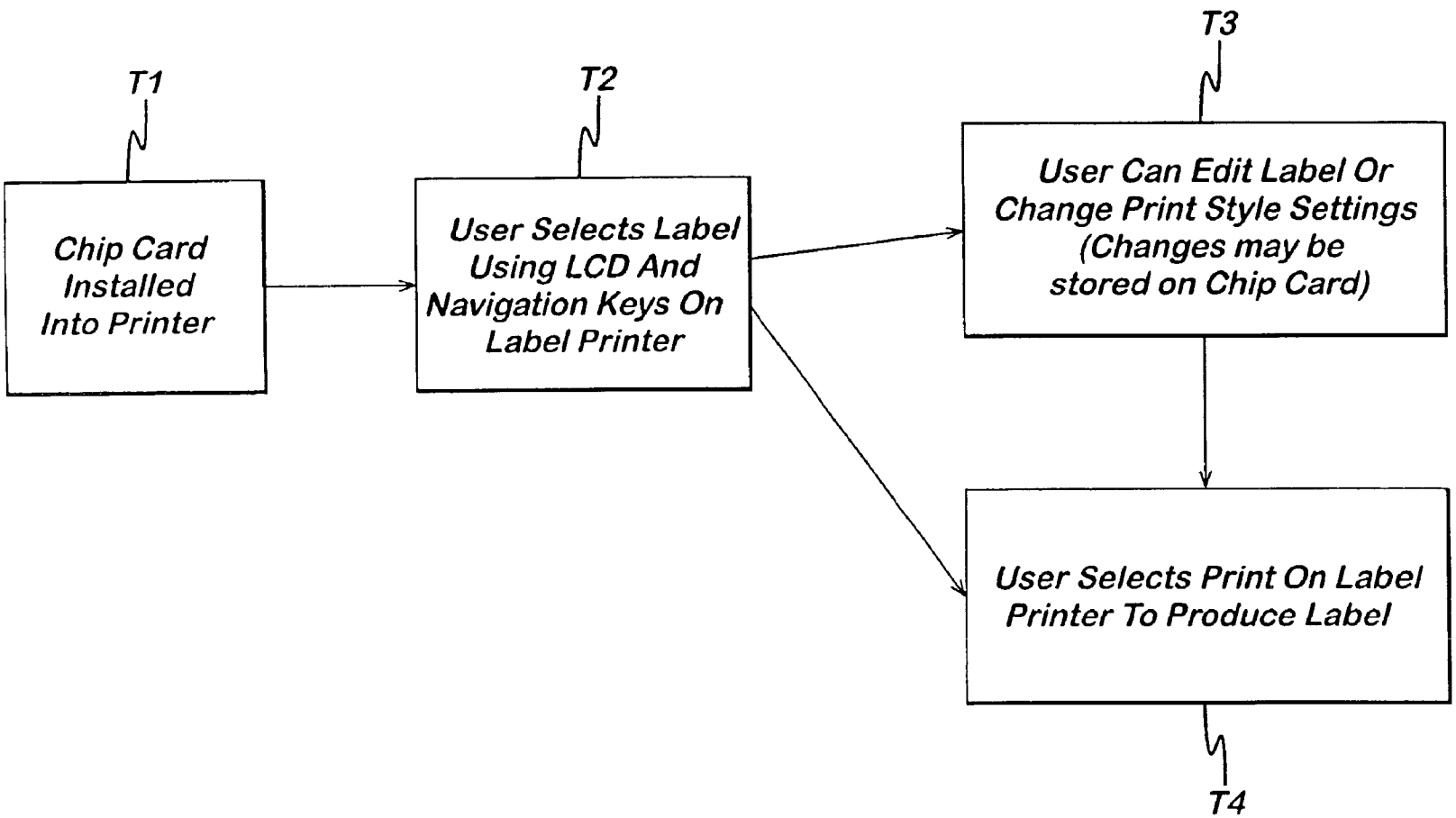
FIG. 8 shows a flow diagram associated with the embodiment of FIG. 7.

Reference is made to FIG. 8 which shows the method by which data stored in the memory card 123 can be selected. In step T1, the chip card is installed in the printer. In step T2, the user, using the keyboard, is able to access a mode in which the user is able to search for labels stored in the memory card. For example, the user may press one or more keys to access the contents of the memory card. Alternatively, the user may be able to make this selection by the use of menus displayed on the display. The labels stored are searched. The labels may have titles which are displayed on the display. The user can move through the titles using the cursor key. Depending on the size of the display, only one or two labels titles may be displayed at a time. Alternatively, the user may be able to search for text in the labels or their titles with those labels relating to the searched for text being displayed. The user may be able to move between the labels using a cursor. As an alternative to displaying the titles of the labels, the labels themselves may be displayed. The user is able to select one of the stored labels. This can for example be done by pressing a particular key such as the enter key.

In step T3 the user can enter data into the label. As previously mentioned, the user is not able to alter some of the data or images contained in the data but may be able to enter some further information. The user can alternatively or additionally completely edit the label as required. The style settings of the label may be alterable. The user can then store the label if required. The label may be stored on the chip card or the like.

In step T4, the user selects the label to be printed. This can be after step T3 or after step T2.

Figure 9:
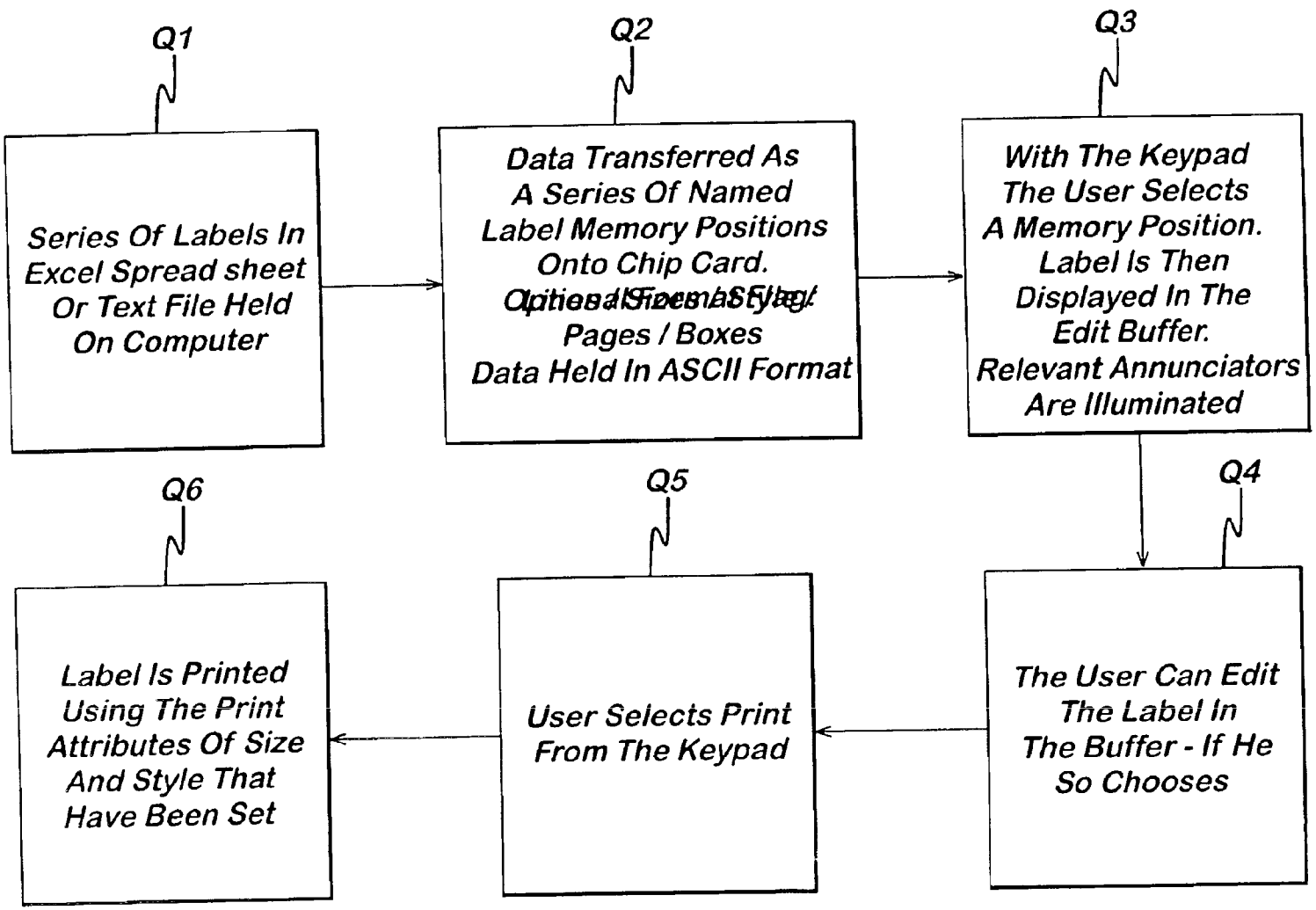
FIG. 9 shows a more detailed flow diagram of some of the steps of FIG. 8.

Reference is now made to FIG. 9 which shows a more detailed method embodying the invention. In step Q1, a series of labels is stored in an Excel spread sheet or text file held on the PC. In step Q2, data is transferred as a series of named label memory positions onto the chip card. There are optional format flag: lines/sizes/style/pages/boxes. The data may be held in ASCII format.

In step Q3, with the keypad of the user selects a memory position. The label is then displayed in the edit buffer of the tape printer and any relevant annunciators are illuminated.

In step Q4, the user can edit the label in the buffer—if he so chooses.

In step Q5, the user selects print from the LP300 keypad

In step Q6, the label is printed using the print attributes of size and style that have been set on the printer.

The above illustration allows only for data that contains alpha numerical data and spaces where the ASCII code will adequately describe the characters that need to be placed into the machine edit buffer. There are additional requirements which may be addressed Should data be needed as a bar code, then a "flag" will be provided to inform the tape printer internal software to treat the following numerals as part of a bar code. The flag would denote the bar code type.

When this data is retrieved from the chip memory It will therefore automatically be treated as a barcode entered manually from the keypad.

A further complication occurs when bar code data is mixed with text. In this case however the bar code flag should be read by the tape printer internal software, which having counted the number of characters applicable to the bar code type, then reverts to normal text A complication is the combination of a graphic and text. However, the data flag will addresses this.

Embodiments of the invention are designed to be simple. Preferred embodiments of the present invention are arranged to operate in a wizard style where the user is prompted as required. Embodiments of the invention may be operable only via a PC, only via the tape printer or by a combination of the two. Embodiments of the present invention are arranged to operate with a full Europeans language set.

The data input used In preferred embodiments of the present invention will now be elaborated 1 The user will be able to enter the data manually into the content slot for any memory position.

2 The user will be able to paste into the label content from the a Window's clipboard or the like.

3 The user should be able to import into any designated range of positions a series of labels from a database in CSV format or TXT format.

4 The user will be able to use smart paste to import a simple series of labels from Excel or the like. This is described in more detail hereinafter.

In preferred embodiments of the present invention, a PC or label printer may be able to display (preferably in WYSIWYG form) the current content of the chip card when the label printer or card reader is connected to the PC or label printer.

To improve the WYSIWG appearance, the font as used by the label printer may be provided with the application. The size and style options for the font thus preferable match the fixed sizes and styles that are available with the label printer.

Table 1 below shows one format which may be displayed at least partially. Thus for each memory location, the data type and label content are shown.

| Memory position | Data Type | Label Content |
|---|---|---|
| CM01 | Text | E.g. How Now Brown Cow |
| CM02 | B code EAN 13 | 1342454433440 |

-continued

| Memory position | Data Type | Label Content |
|---|---|---|
| CM03 | Graphic | |
| CM04 | Mixed | Widget ( B code flag) 1233434344 |
| CM05 | | |
| CM06 | | |
| CM07 | | |
| CM08 | | |
| CM09 | | |
| CM10 | | |
| CM27 | | |
| CM28 | | |
| CM29 | | |
| CM30 | | |

Figure 10:
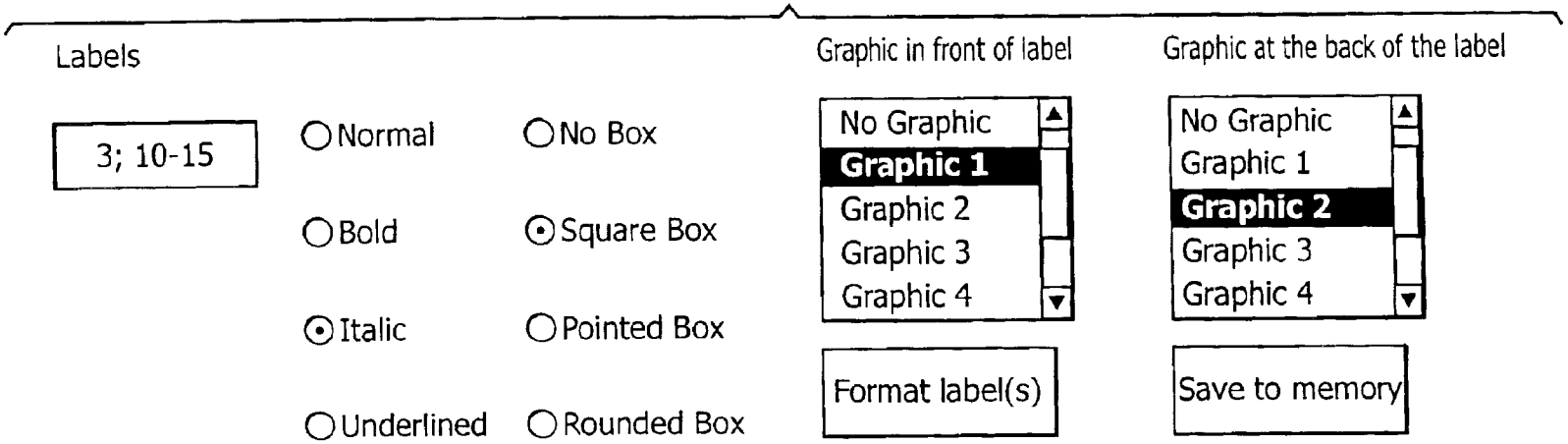
FIG. 10 illustrates the addition of a graphic element.

Alternatively, the graphics may be stored separately from the text as shown in FIG. 9. Such a system has the advantage of being memory space efficient as the bitmap image for the graphic only needs to be stored once for use on any labels. Such an example would be a company logo to prefix many labels In the example shown in FIG. 10, the labels can be selected and would for example be labels 3, 10, 11, 12, 13, 14 and 15. These labels would be in Italic and have a square box around them. In the example, at the beginning of the label, there would be graphic 1 and at the end, there would be graphic 2. The graphics from the dropdown menu would be fetch from a directory called graphics. In addition, a user can add multiple graphics by selecting multiple graphics inside Windows explorer or the like and copy them into the specified directory. In addition, the user can add a single bitmap by using an import bitmap function.

The option Format Label(s) would do the actual job of formatting the selected label with the specified formats.

The Save to memory option would then program the changes onto the memory card.

Embodiments of the invention may address problems associated with multiple lines, as this is dependant on the tape size used and indicates a tape mismatch from the tape switch if the label cannot be printed.

The edit mode allows the user to change the content of a single label. The user may or may not be able to change the format, but the text inside the label can now be changed.

The scroll bar (or any way of selecting labels one by one) would let the user scroll through the labels he wants to edit.

Figure 11:
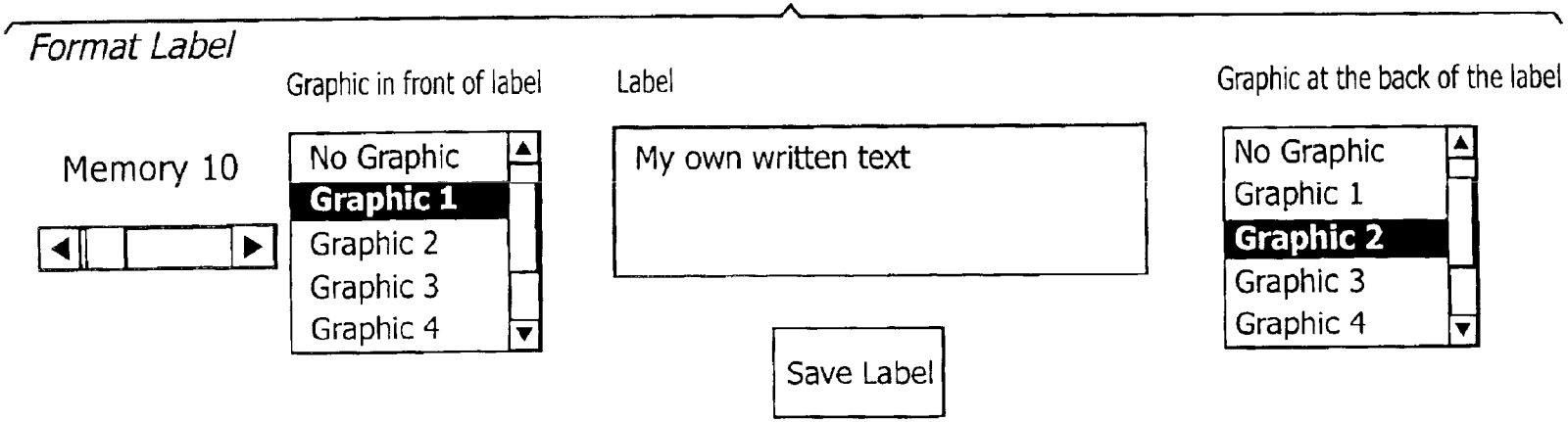
FIG. 11 shows a format label display.

All options that are available by the format mode illustrated in FIG. 11 can also be performed with the edit window. By the layout of the menu, the user would know how the changes are made.

The content may be saved as a single file. i.e. the content of the chip could be fully reinstated at any time in the future.

Once the user is satisfied he can select chip card update and the data will be transferred to the card, alternatively, within an independent read/write device.

If the data being transferred is to overwrite an existing label a warning message is presented in typical windows fashion with an ignore all option.

Embodiments of the present invention are able to make a distinction between the parts of label which are editable and those parts which are not. In particular, the label which is downloaded contains the field in which any text or the like entered by the user is automatically placed.

In alternative embodiments of the present invention, the memory card may be replaced by an entity containing a microprocessor or the like. The microprocessor can be contained in any suitable carrier. The integrated circuit may be carried in a card or contained in a device which can be plugged into the tape printer. The microprocessor can be arranged to augment the functionality provided by the microprocessor 100 shown in FIG. 3 or may be arranged to take over the control of the tape printer. The microprocessor would generally include a microprocessor part and additionally some memory capacity. The memory capacity can take any suitable format and may be ROM and/or RAM memory or any other suitable type of memory. The memory may contain programming to control the operation of the microprocessor. The programming contained on the microprocessors can control the tape printer to perform functions which the tape printer is not able to perform without that programming. For example, the tape printer can be provided with a basic microprocessor and functionalities with more sophisticated functions controlled by the plug in microprocessors. For example, the microprocessor can control the tape printer to carry out more sophisticated processing of data.

The tape printer may be arranged to receive the microprocessor or the like as well as a memory card as described.

The memory can be a flash memory of the like.

In some embodiments of the present invention, the printer may incorporate a time stamp. The time stamp can be used to insert the date and/or time into labels.

The interface between the memory card, or microprocessor and the microprocessor of the tape printer is via a serial interface. In the case of a card or the like containing a microprocessor, a parallel interface may be provided.

In yet a still further embodiment of the present invention, the tape is replaced by a supply of discrete labels provided on a backing layer. In other words, the labels are die cut and when printed are simply removed from the backing layer without requiring cutting.

What is claimed is:

1. A tape printing system for printing an image on an image receiving tape comprising:

means for receiving a supply of image receiving tape;

means for generating a plurality of labels from a data source, said generating means comprising means for receiving said data, means for processing said data to identify a plurality of individual label data fields to be printed on said plurality of labels and means for generating label data from the identified individual label data; and means for printing said plurality of labels.

2. A system as claimed in claim 1, wherein said processing means are arranged to determine the position of blank lines in said data source.

3. A system as claimed in claim 1, wherein a blank line or the end of the data is indicative of the end of a label.

4. A system as claimed in claim 1, wherein said generating means is arranged to determine if blank lines are present and if so to generate said plurality of labels.

5. A system as claimed in claim 1, wherein said data source comprises a list, each entry on said list being one of said plurality of labels.

6. A system as claimed in claim 5, wherein said processing means is arranged to provide a label for each line of said list.

7. A system as claimed in claim 1, wherein said processing means is arranged to determine the presence of a predetermined indicator, said indicator determining the number of lines in a respective label.

8. A system as claimed in claim 7, wherein said indicator comprises a comma.

9. A system as claimed in claim 7, wherein said processing means are arranged to determine the presence of a second predetermined indicator, said second predetermined indicator indicating that an associated presence of a said first predetermined indicator is ignored when determining the number of labels.

10. A system as claimed in claim 9, wherein said second predetermined indicator comprises inverted commas to end the occurrence of said first predetermined indicator, and the space occupied by the first predetermined indicator is ignored when determining the number of lines.

11. A system as claimed in claim 9, wherein said second predetermined indicator is not printed on said label.

12. A system as claimed in claim 1, wherein said data source comprises one of a plurality of formats and said generating means is arranged to determine the format of said data file and to generate the plurality of labels in dependence on the determined format.

13. A system as claimed in claim 1, wherein said supply of image receiving tape is provided in a cassette.

14. A system as claimed in claim 1, wherein said tape printing system comprises a stand alone tape printer.

15. A system as claimed in claim 1, wherein said tape printing system comprises in combination a tape printer and a personal computer.

16. A tape printing method for printing an image on an image receiving tape comprising the steps of:

receiving data containing information for a plurality of individual labels;

processing said data to identify a plurality of individual label data fields to be printed on said plurality of individual labels;

generating a plurality of individual labels from the identified data; and printing said plurality of individual labels.

17. A tape printing system for printing an image on an image receiving tape comprising:

a source of image receiving tape;

a data input device capable of accepting a data file from another electronic source, wherein the data file comprises label data to be printed on said plurality of labels and a predetermined indicator separating data for individual labels;

a data processing device capable of reading the data file, parsing the data file into a plurality of data fields, selecting fields for printing an individual label, and sending data for an individual label or labels to the printer; and a printing device capable of printing the data for individual labels sent from the data processing device onto a plurality of individual labels.

18. The tape printing system of claim 17 wherein the predetermined indicator is a symbol or a blank line.

19. The tape printing system of claim 17 wherein the data file also comprises format information which is readable by the data input device.

20. A tape printing system for printing an image on an image receiving tape comprising:

means for receiving a supply of image receiving tape;

means for generating a plurality of labels from a data source, said generating means comprising means for receiving said data, means for processing said data to identify a plurality of individual label data to be printed on said plurality of labels and means for generating label data from the identified individual label data; and means for printing said plurality of labels wherein said processing means is arranged to determine the presence of a predetermined indicator, said indicator determining the number of lines in a respective label, wherein said processing means is further arranged to determine the presence of a second predetermined indicator, said second predetermined indicator indicating that an associated presence of a said first predetermined indicator is ignored when determining the number of labels, wherein said second predetermined indicator comprises inverted commas to end the occurrence of said first predetermined indicator, and the space occupied by the first predetermined indicator is ignored when determining the number of lines.

21. A tape printing system for printing an image on an image receiving tape comprising:

means for receiving a supply of image receiving tape;

means for generating a plurality of labels from a data source, said generating means comprising means for receiving said data, means for processing said data to identify a plurality of individual label data to be printed on said plurality of labels and means for generating label data from the identified individual label data; and means for printing said plurality of labels wherein said processing means is arranged to determine the presence of a predetermined indicator, said indicator determining the number of lines in a respective label, wherein said processing means is further arranged to determine the presence of a second predetermined indicator, said second predetermined indicator indicating that an associated presence of a said first predetermined indicator is ignored when determining the number of labels, wherein said second predetermined indicator means for receiving a supply of image receiving tape is not printed on said label.

22. A tape printing system for printing an image on an image receiving tape comprising:

means for receiving a supply of image receiving tape;

means for generating a plurality of labels from a data source, said generating means comprising means for receiving said data, means for processing said data to identify a plurality of individual label data to be printed on said plurality of labels and means for generating label data from the identified individual label data; and means for printing said plurality of labels; wherein said data source comprises one of a plurality of formats and said generating means is arranged to determine the format of said data file and to generate the plurality of labels in dependence on the determined format.

* * * * *